United States Patent [19]

Shockley

[11] Patent Number: 5,062,717

[45] Date of Patent: Nov. 5, 1991

[54] SHOPPING BAG WITH HANDLE

[76] Inventor: Dru Shockley, 3904 McTyres Cove Ct., Midlothian, Va. 23113

[21] Appl. No.: 606,599

[22] Filed: Oct. 31, 1990

[51] Int. Cl.[5] ..... B65D 33/02; B65D 33/14

[52] U.S. Cl. ..... 383/20; 383/104; 383/107; 383/125

[58] Field of Search ..... 383/6, 17, 20, 104, 383/107, 125

[56] References Cited

U.S. PATENT DOCUMENTS

| | | | |
|---|---|---|---|
| 2,325,853 | 8/1943 | Harlem . | |
| 2,529,976 | 11/1950 | Strandberg . | |
| 2,603,408 | 7/1952 | Crary . | |
| 2,955,740 | 10/1960 | Finke . | |
| 2,960,136 | 11/1960 | Ziff | 383/110 |
| 2,985,355 | 5/1961 | Read . | |
| 3,021,767 | 2/1962 | Hamilton . | |
| 3,409,209 | 11/1968 | Finke | 383/20 |
| 4,062,392 | 12/1977 | Ishii . | |
| 4,356,854 | 11/1982 | McGee | 383/104 |
| 4,521,911 | 6/1985 | Vance | 383/20 |
| 4,646,357 | 2/1987 | Natrass | 383/6 |

FOREIGN PATENT DOCUMENTS

| | | | |
|---|---|---|---|
| 1237028 | 6/1960 | France | 383/6 |
| 314618 | 7/1929 | United Kingdom | 383/6 |
| 568872 | 4/1945 | United Kingdom | 383/6 |
| 1122437 | 8/1968 | United Kingdom | 383/120 |
| 2127776 | 4/1984 | United Kingdom | 383/6 |

*Primary Examiner*—Gary E. Elkins

*Attorney, Agent, or Firm*—Dennison, Meserole, Pollack & Scheiner

[57] ABSTRACT

A shopping bag for general purpose use in constructed from a sheet of fabric and formed by a series of steps into top and base portions integrally connected to side panels and back and front panels joined by a single seam which extends the length of the bag. The folding operation creates a multiple ply border about the upper or open portion of the bag. Selvage on the fabric is directed to form a portion of the base such to extend around the perimeter of the base integrally connected with the side panels and the back and fornt panels. A pleated construction of the side panels allows the bag to fold compactly when not in use such as when being carried or transported. The mouth of the bag when accepting articles is generally rectangular in shape. The inner and outer creases of the bag are reinforced from top to botton thus imparting to the side panels a rigidity which projects them essentially transversely to the back and front panels when the bag is trimmed for use. The base of the bag likewise is reinforced by a plurality of plies. A handle may be attached to the border at the upper end of the bag.

10 Claims, 4 Drawing Sheets

SHOPPING BAG WITH HANDLE

BACKGROUND OF THE INVENTION

1. Field of the Invention

The present invention relates to improvements in the manufacture of general purpose shopping bags or containers of the kind capable of holding a variety of products and suited structurally to replace the shopping bag traditionally made of paper or other natural fiber For shopping bags of the handle type, the present invention teaches a handle cut and applied to the mouth of the bag in an improved and simplified manner.

2. Description of the Prior Art

Paper bags and other conventional commercial bags made of natural fibers or sheets are generally manufactured by a series of cutting, measuring, folding and sealing operations capable of producing large numbers of bags on automatic machinery. Such bags are routinely used in daily business transactions on such a scale that the magnitude of their number cannot accurately be measured. It is commonly known that bags made of paper or other light natural fibers and presently being constructed are unable to tolerate without incurring damage the punishment inflicted by contents having sharp edges and corners. Such articles frequently pierce or otherwise perforate the enclosing surfaces of the bag. The bottom or closed ends of these bags are also found to be inherently faulty in that they lack sufficient strength to contain articles whose combined weight approaches design limits. Generally recognized also by the industry is the fact that wholesale disposal of paper bags by consumers, usually following only a single transaction, is a common occurrence. A steady production cycle of replacement units is thus guaranteed by such wasteful practices. New production lots are destined as their predecessors to experience a brief commercial existence terminating in a final trip to the residential trash or garbage receptacle.

The manufacture of conventionally made bags produced by machines in which a sheet of paper from a stock roll ends up as a finished bag has thus provoked public awareness and concern over environmental issues. Conservative estimates show that discarded paper products represent approximately 48% of all material deposited in landfill operations. Changes in the everyday shopping lifestyle of the average consumer will become necessary if the reduction of the world's natural resources is to be reversed. The annual destruction in this country alone of over one and one quarter billion trees to supply raw material for paper bags deserves the unlimited attention of any shopper habitually relying on a steady supply of commercial paper bags. The reusable cloth grocery bag of the present invention and its method of manufacture offers a solution partially if not wholly in satisfaction of environmental issues affected by current manufacturing processes. An improved handle more durable and comfortable to use than handles for bags heretofore used is intended to improve the longevity of the bag according to the present invention.

Patents which pertain to the art of shopping bags exist in large numbers. Several of the more pertinent patents are discussed immediately below.

One example of a bag and a method of making it is disclosed in U.S. Pat. No. 2,985,355. The patent teaches a method of making a bag from a planar web of paper cut into bag blanks as it passes through a machine, to provide, among other things, a bag which is siftless.

U.S. Pat. No. 4,062,392 shows dual purpose handles alternatively useable according to the whim of the carrier and this forms a distinctive feature of the bag described in this patent.

Another manufacture of a paper bag is shown in U.S. Pat. No. 3,021,767. The disclosure therein is directed essentially to a method for providing a cuff which serves primarily to reinforce the open end of the bag.

One other construction is the collapsible shopping bag shown in U.S. Pat. No. 2,325,853 whose important feature relies on the use, around the mouth of the bag and at the bottom, of stiff pieces of cardboard. The strips at the mouth of the bag tend to hold the mouth open approximately square and the stiffeners at the bottom urge the side walls apart and also provide a flat base.

The handle for carrier bags which is shown in U.S. Pat. No. 2,955,740 comprises a flat strip of foldable material, such as paper, divided longitudinally along an extendable center line which divides the strip into two portions each half the width of the strip. The two portions after having been folded into the same plane form the grip portion of the handle. A drawback of this form of construction is the weakness or thinness of a bi-fold panel the portions of which are not stitched or otherwise fastened to each other.

U.S. Pat. No. 2,603,408 to Crary teaches a shopping bag with a U-shaped handle or strip formed of paper folded edgewise upon itself a plurality of times throughout its entire length. The multiple ply paper strap of the form shown in the Crary patent is adopted for manufacture of handles for paper bags. No means is taught for securing the folds of paper relative to each other, in the form of stitching, for example, and the patent excludes the use of additional adhesive between the folded edge portion for accomplishing this purpose.

The handle manufacturing method disclosed in U.S. Pat. No. 2,529,976 obtains a multiply-folded length of paper on lines which are parallel with the edges of the strip. At each fold, the strip is coated with a suitable paste and each handle is folded in three parts so that a cross piece is s obtained. A piece of suitably rigid material is inserted in the cross piece. An imperfection in this form of construction is that the handle grip is susceptible to breakdown of the adhesive and becomes tacky when grasped by the moistened surface of the palm.

Although generally satisfactory results can be expected from the above-exemplary articles and methods, their main purpose is to improve one or more separate characteristics or features in that class of articles known as shopping bags. Their general focus upon paper as the base material used in manufacture and their concentration on limited development of only one segment of paper bags is detrimental to a vital concern over environmental issues which should be reflected in all phases of the manufacturing process.

SUMMARY OF THE INVENTION

The invention is summarized as a shopping bag and method of making the same in a general purpose bag construction or container having an improved handle. Stock material for the bag is in the form of a planar sheet or blank of fabric made to have a firm supporting lower end and an upper end which is open for insertion of articles into the interior. When open and upright, the bag comprises parallel front and back panels having their corresponding longitudinal edges joined together by opposed sidewall portions inwardly folded in the form of V-shaped pleats. The top of the bag owes its formation to folds taken during the first steps of construction from the back and front panels and the two side-wall portions. This initial folding operation creates a heavily reinforced border or web of triple thickness which extends completely around the open end of the bag and downwardly into the bag by a depth of several inches. Adjacent the base of the bag the selvage edge is brought together with adjoining edges of cloth to form two inwardly extending triangular or gusset shaped folds positioned on the bottom of the bag such that the base of each gusset overlaps one of the narrow sides of the base. A line drawn between the tips of the gussets coincides substantially with the centerline of the bag drawn along the longitudinal axis of the base. Stitching provided through and along the base at the edges thereof joins the base of the bag to the back and front panels and the two side wall portions. The four outer creases of the bag which form the corners and the two inner creases at the pleats are provided with a reinforcing stitch or seam which extends through the border or web at the upper end of each corner. The reinforced border at the top of the bag serves to present a clearly defined rectangular opening when the bag is placed upright for the reception of articles. The manner of creating the outer creases provides four essentially rigid columns which act as corner posts to materially assist in maintaining the bag in fully upright condition when the bag is opened for filling. The creases provide additional strength against tearing or ripping owing to the long stitched seam which runs the length of the bag. At the base of the bag on the exterior surface which serves as the bottom the selvage runs along both long sides of the base. Not exposed owing to the folding operation, but instead hidden from view by the stitching about the perimeter of the base, the selvage also runs along both short sides of the base. The heavier weave offered by the selvage makes a substantial contribution to maintaining the outline of the base of the bag under any circumstances. It also provides a thicker thread better resistant to wear during times when the base of the bag is being pulled relative to a supporting surface. The base, in addition, is of two-ply construction. To employ the handle, it is assembled during the final steps of construction. Despite the box-like appearance of the bag when placed upright and open for filling, it collapses readily upon itself for convenient storage, carrying or shipment.

The improved bag of the invention may readily be made by a sequence of easily understandable steps which may be performed manually or automatically. Thus, as a first step, a sheet of fabric of predetermined length is drawn from a large roll and placed upon a substantially horizontal working surface with the selvage edges exposed at the top and bottom thereof. The side of the fabric exposed to view in this position will ultimately constitute the inner surfaces of the bag when it is fully assembled. Conversely, that part of the fabric resting on the working surface will ultimately appear as the outer surface of the bag. At a predetermined distance taken several inches from the top of the fabric, a strip is removed from the fabric throughout the entire length thereof. This leaves a rough edge at the top of the fabric and the strip is set aside to be used later in the construction of a handle. Now only the bottom edge of the fabric shows the selvage. A plurality of vertically extending scribe or fold lines are then marked on the fabric from top to bottom and these include a fold at the center as well as six additional folds which denote the locations the four corner creases and the two inner creases. The distances from the center crease on each side panel to the two outer creases forming each pleat are symmetrical and this distance determines the rectangular dimensions of the bag. Thereafter, four horizontally extending fold lines are marked on the fabric throughout its entire length. The distance between the center two horizontal fold lines represents the height of the bag. The rough edge of the fabric caused by snipping the strip for the handle is eliminated by folding the top backward 180 degrees about the top-most fold line and stitching a seam the entire length of the fabric. The upper edge of the fabric is again smooth and is no longer able to ravel. The upper border or web is then formed by folding the fabric forward on the fold line second from the top and then refolding it back on itself such that the ragged edge of the fabric is hidden in a three-ply thickness the top of which represents the top of the bag. The folds are then stitched in place. Thereafter, the bottom of the bag, taken at the ends of the selvage, is folded up, or forward, to form the fold line next from the bottom of the fabric, folded back 180 degrees against itself and stitched to connect the selvage to the bottom fold line, and again unfolded such that the selvage is hidden underneath from view. The distance from the top of the fabric to the selvage line represents the height of the bag. The fabric remaining below construction of the base. Each of the six creases is folded back upon itself and a stitch is run between the top of the fabric and the selvage. To form the back seam, the edges are then brought together and stitched with a flat-fell seam which runs completely between the top and bottom of the bag. After the operation of forming the back seam, the back seam and the center fold are aligned with each other and a flat-fell seam is placed the length of the base. At this stage, the bag is turned inside out, that is, inverted, such that the exterior surface of the bag is now exposed. The corners of the bag are now represented by the location of the outer creases. As a result of tucking in the base, a folded, flattened pair of gussets at the bottom of the bag takes the form of triangular wedges inwardly extending toward each other but separated by a gap between their tips. In completing the bag, the portion of the base folded such as to cause the selvage to be in overlapping relationship is rolled back a distance to cause the appearance of the selvage along both the long edges of the base. The base of the bag is now integrally connected to the bottom of the side panels by a seam which extends between adjacent corner creases. At this point, selvage extends completely about the perimeter of the base and is visible along the long edges of the base but hidden from view along the short edges of the base because of the seam. The base of the bag now comprises two plies of fabric whose strength is supplemented by the overlapping folds of the gussets. The bag as assembled readily supports attachment of a handle securely to the border or web.

Accordingly, an object of the invention is a shopping bag which presents a sharply defined rectangular opening when placed upright for the reception of articles.

Another object of the invention is to create additional strength at the corners of a shopping bag to better outline the opening of the bag when objects are being inserted.

A further object of the invention is the provision of an improved bag by strengthening the load containing and load bearing surface through multi-ply construction of fabric about the mouth of the bag and at its base.

Another feature of the invention is the novel application of the selvage on a blank of fabric wherein the selvage is advantageously positioned in directions coinciding with the outline of the bag and complementary to resist abrasive forces working against the base.

Still another feature characterizing the invention is the development of a method of making shopping bags wherein multiple layers of fabric are formed and folded into a base in an improved and simplified manner.

Another object of the invention is the development and manufacture of a handle in which a strip of fabric in a handle type bag, provides maximum attention to user comfort and minimum assembly time and installation.

Still a further object of the invention is to provide a shopping bag constructed of a durable fabric having one or more of the following preferable features: strength, simplicity, and resistance to wear.

Other objects of the invention will become apparent from the following detailed description of the embodiment of the present invention when taken in conjunction with the accompanying drawings.

DESCRIPTION OF THE PREFERRED EMBODIMENT

Figure 1:
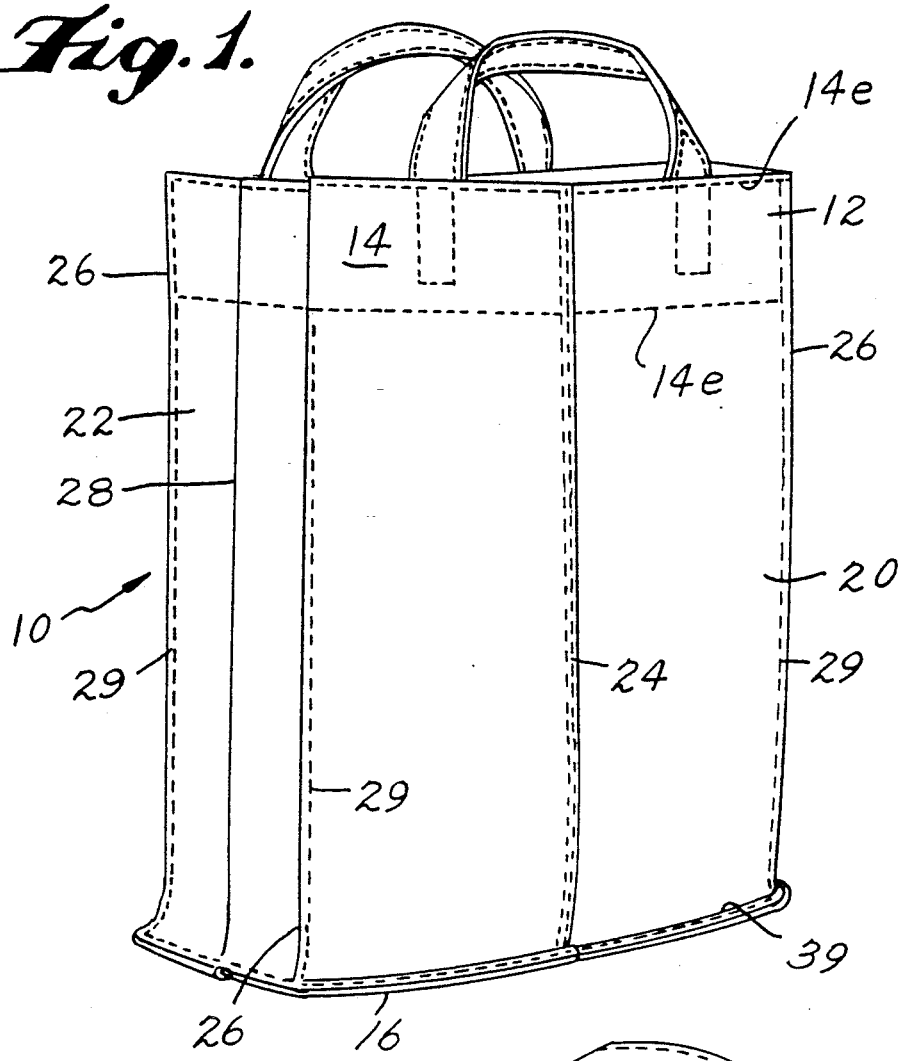
FIG. 1 is a perspective view showing the bag according to the invention and the points of attachment of the handles.
Figure 2:
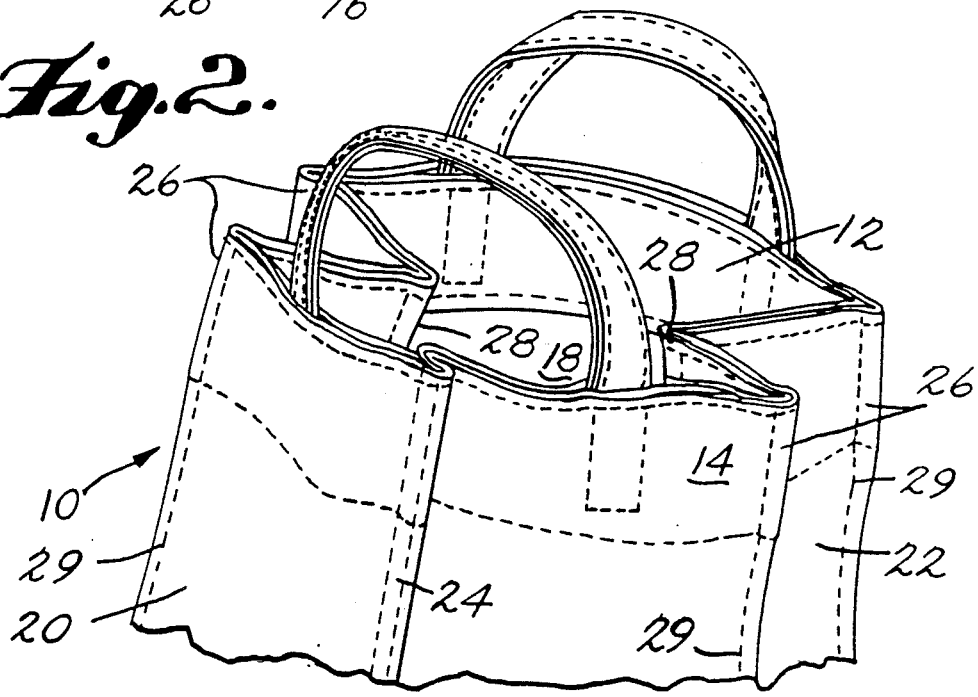
FIG. 2 is another view of the bag in perspective, but particularly the upper part to shown the bag partially collapsed in order to illustrate the creases and their reinforcement at the upper border or web.
Figure 3:
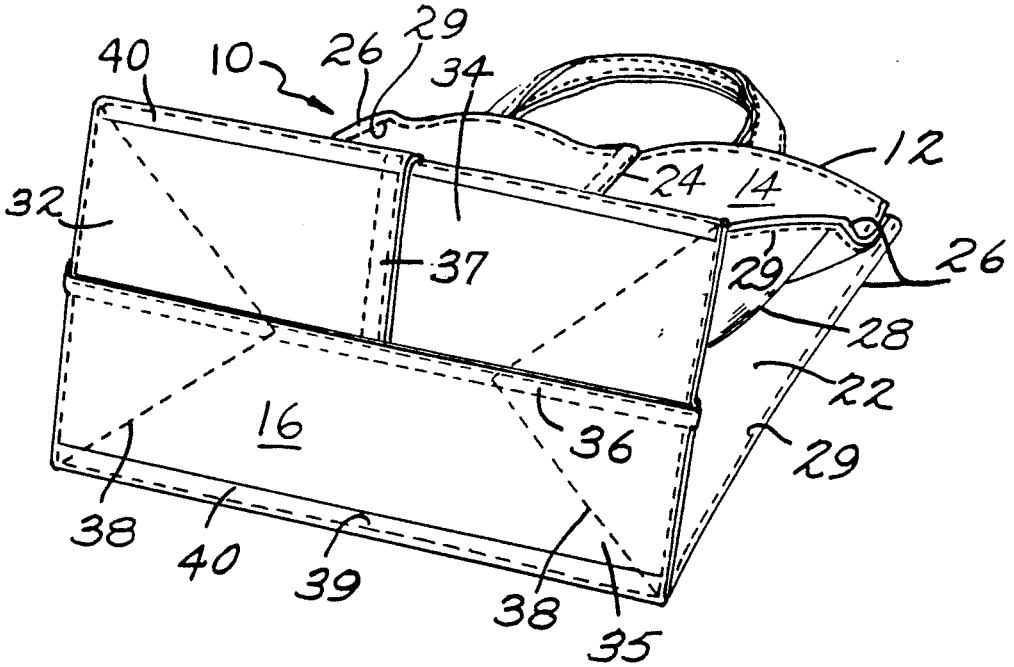
FIG. 3 is a perspective showing the formation of the base of the bag and those selvage lines that are exposed.

A completed bag embodying the invention is shown in FIGS. 1–3. The detailed construction of the bag will be more fully understood once after subsequently describing the method by which it is made. As shown in FIGS. 1–3, the bag is generally indicated by the reference numeral 10 and comprises an upper end 12 of generally rectangular form having a circumferential reinforcing border or web 14 extending around the perimeter thereof. The opposite end of the bag, as best shown in FIG. 3, is provided with a bottom closure preferably adopted in the form of a rectangular base 16.

Figure 10:
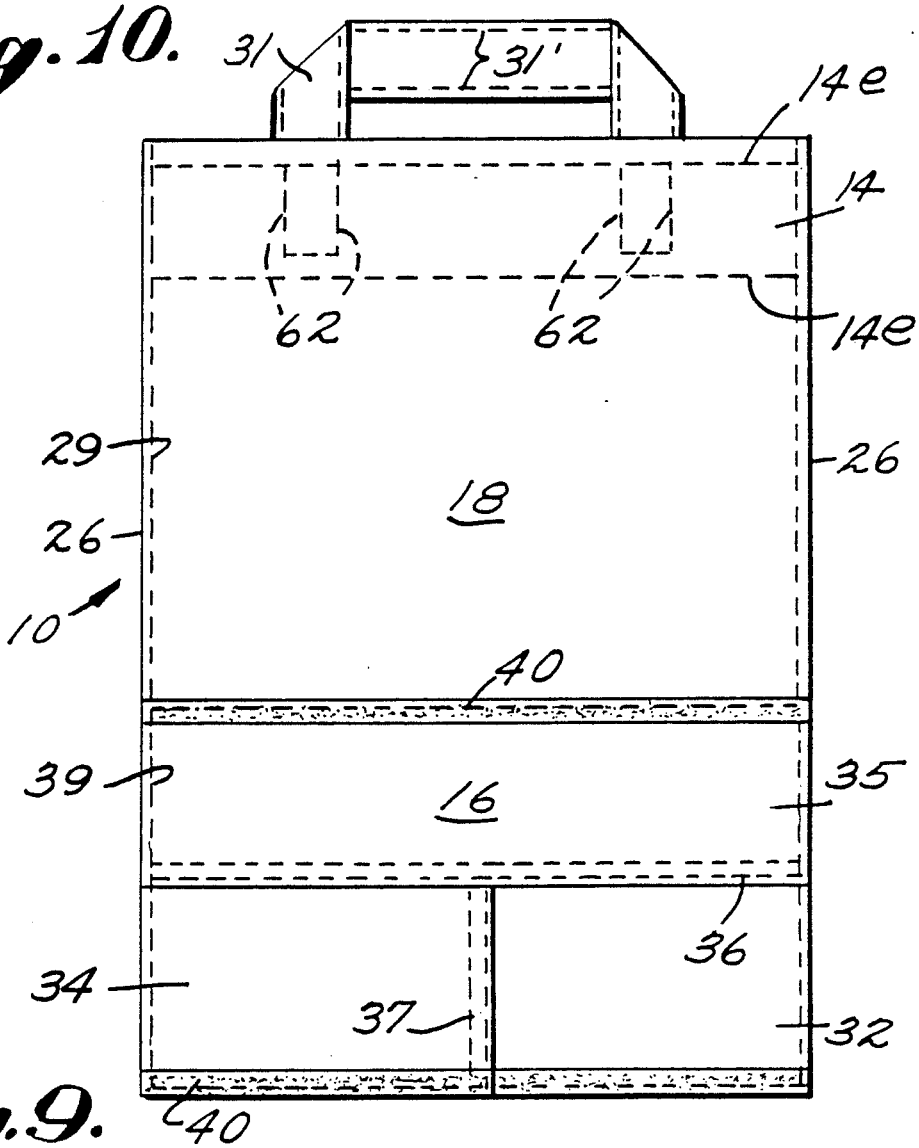
FIG. 10 shows a completed bag folded flat with the base collapsed and the handle attached.

The tubular body of the bag 10 comprises parallel front and rear panels 18 and 20, respectively, which, when the bag is in a flat folded or carrying position, are arranged with one collapsed upon the other as shown most clearly in FIG. 10. The corresponding longitudinal edges of the front and rear panels 18 and 20 are integrally connected together by pleated side pieces 22. A back seam 24 extends the height of the rear panel 20 substantially along the center line of the back panel.

The boundaries of the pleated side pieces 22 are indicated by four outer corner creases 26 and two inner corner creases 28. The side pieces 22 may be folded inwardly between the front and rear panels 18 and 20 so that each of the side pieces comprises two similar sections which are connected to corresponding longitudinal edges of the back and front side panels and extend transversely thereto when the bag is fully open. When the bag is placed in a folded position, the pleated side pieces become flattened and are disposed in contact with each other and with the inner surfaces of the front and rear panels. Each of the inner and outer corner creases is folded slightly over upon itself and, by means of suitable machine threading, is provided with a reinforcing stitch or seam 29 which extends completely between the top and base of the bag. The seams 29 do not interfere with the opening of the bag during the period of inserting articles but, in fact, promote the maintenance of a firm rectangular opening along the length of the bag by acting essentially as semi-rigid columns or posts in support of holding a rectangular outline when the bag is being filled.

The border or web 14 extending around the upper end 12 of the bag comprises a triple ply layer of folded strips 14*a*, 14*b*, and 14*c* (FIG. 7) which are in an overlapping relationship with each other in the manner of a fold or crease having the appearance of an accordion hinge. Preferably, the rough edge 14*d* of the fabric from which the bag is constructed is folded over onto itself 180 degrees into a position lying intermediate the strips 14*b* and 14*c* so as to be concealed within the interior of the border or web such that any raveling of the top edge of the fabric is avoided. While not connected to each other by suitable stitching or seam 14*e* (FIG. 10) which extends about the periphery of the web 14 in a complete circle so that the three strips become integrally connected to each other. The multiple folds thus provide reinforcement or strength to the outline of the upper part of the bag.

As will hereinafter be described, the cleavage at the top of the bag which separates the folds associated with the strips 14*a*, 14*b*, and 14*c* may be separated advantageously in order to provide a slit or flap in which the handles for the bag may be inserted and secured.

Figure 7:
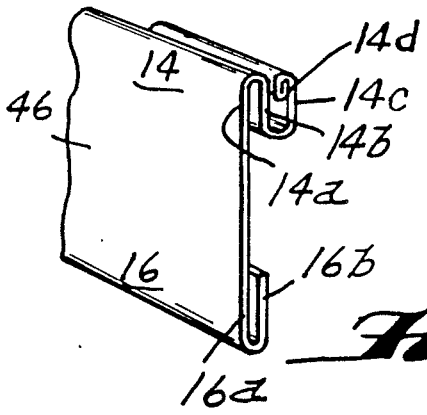
FIG. 7 is a fragmentary perspective view illustrating the step of forming a triple ply border or web adjacent the top of the bag, and the fold of the selvage at the base prior to forming the back seam by joining the ends of the fabric.

Further shown in FIG. 7 is the formation of the parts 16a and 16b of the base 16 creased back in a fold which ultimately in the manufacturing process, in a manner more fully to be described, produces a base which is of two-ply construction.

Figure 6:
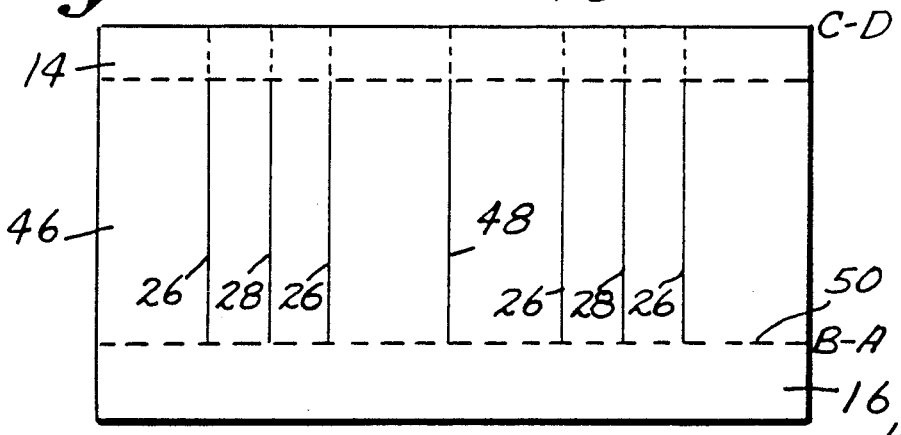
FIG. 6 illustrates a sheet or blank which corresponds to FIG. 4 showing a stage of construction in which the areas are established for the formation of the upper and base portions of the bag.

When the bottom of the bag is sealed it appears as shown in FIG. 3. Two adjoining base panels 32 and 34 essentially of the same area are joined and integrally connected to a larger base panel 35 at which seams 36 and 37 meet at right angles. Once the material shown in FIG. 6 is formed into the base 16 of the bag, the panels 32, 34, and 35 join in the formation of gussets 38 shown in phantom in FIG. 3. As a result of tucking in the base folds, the gussets 38 appear on the interior of the bag and take the form of triangular wedges inwardly extending toward each other but separated by a gap between their tips.

It will thus be appreciated that the material 16a and 16b, as shown in FIG. 7 comprising the base 16, reappears in FIG. 3 as the base 16 folded such as to create the gussets 38 and the three base panels 32, 34 and 35. The base 16 of the bag is integrally connected to the bottom of the side pieces 22 and the front and rear panels 18 and 20 by a seam or stitch 39 which extends completely around the perimeter of the base, in a manner best shown in FIG. 10.

The exposed selvage in FIG. 3 is represented by the reference character 40. The selvage 40 is also made visible in FIG. 10 by means of the stippled areas 40 shown at the long edges of the base. It thus will be appreciated that the selvage also extends within the short edges of the base 16 but is hidden from view in FIGS. 3 and 10 adjacent the bottom of the corresponding side pieces.

The reinforcement at the perimeter of the base provided by the selvage materially contributes to the strength of the bottom surface of the bag. Due to its thicker weave, it also heightens resistance to any abrasive forces acting upon the bag such as may occur by dragging the bag over a rough, supporting surface.

Having referred to the construction of the bag of the preferred embodiment, further understanding of the invention will be obtained by describing the method of making the bag.

As previously indicated, the bag of the preferred embodiment is preferably made from a sheet or blank of cloth or other suitable natural material. Thus, in FIG. 4, there is shown generally a planar sheet 46 of fabric from which the bag will be constructed. From the standpoint of producing a bag having maximum ability to support a load without tearing or collapsing, it will be appreciated that in the preferred embodiment a single planar sheet of material will be employed rather than lean toward a construction in which multiple panels are assembled into a unitary structure.

At the preliminary stage, the sheet 46 is provided with a vertical center line 48 which divides the sheet into two equal sections. At a predetermined distance both to the left and to the right from the line 48 the inner corner creases 28 are marked or drawn on the sheet 46. At the same time, the outer corner creases 26 are drawn both to the left and to the right of the inner corner creases 28, as viewed in FIG. 4, by a predetermined distance. This distance establishes the rectangular dimensions of the bag in terms of the width of the pleated side pieces 22. The front panel 18 will be understood to comprise both of the rectangular areas which lie astride the center line 48 out to the adjacent outer corner creases 26. The rear panel 20 is formed by the juncture of the ends of the sheet, as will hereinafter be described, so that the dimensions of the rear panel 20 are the same as the dimensions of the front panel 18.

Figure 4:
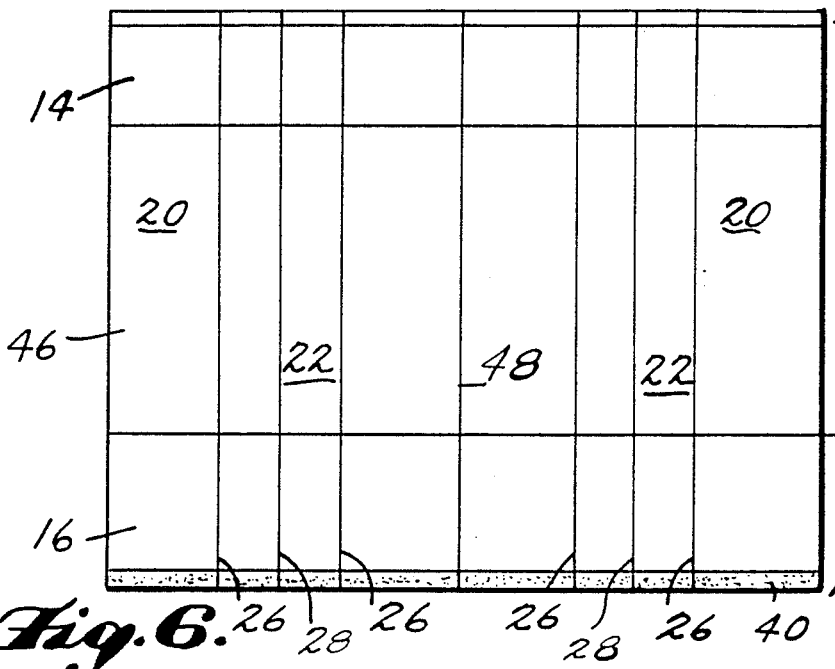
FIG. 4 illustrates a flat sheet or blank of fabric material for use in making a bag embodying my invention, particularly to show vertical and horizontal fold lines instrumental in the steps of manufacture.

The sheet 46 as shown in FIG. 4 is now in condition for the sequential steps of folding the material to include the formation of the border or web 14 and the base 16.

Figure 5:
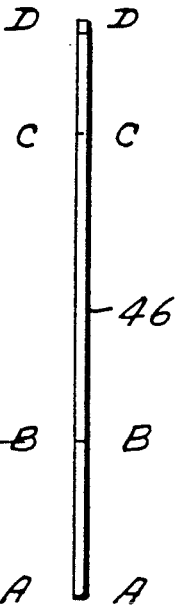
FIG. 5 is a side view of FIG. 4.

After the vertical fold lines have been established, it is now desired to establish the fold lines by which the dimensions of the border or web 14 and the base 16 will be measured Thus, three fold lines transverse to the vertical lines 26, 28 and 48 are drawn parallel to each other across the width of the sheet 46 by predetermined distances measured from the bottom edge of the fabric. In FIG. 4, and as shown in FIG. 5 as well, the horizontal fold lines are identified by the lines B, C, and D. The line A represents the bottom edge of the fabric. In this position of the sheet 46, the selvage 40 is visible and is represented by the slightly darkened area which extends above the line A completely across the length of the sheet.

With the sheet in FIG. 4 having been marked with the horizontal and vertical lines, the top part of the sheet 46 is folded under itself 180 degrees upon the fold line D in order to remove from further contact the rough edge 14d and thus prevent the fabric from raveling during the production process. This edge 14d, as described hereinabove in connection with FIG. 7, is sandwiched between the overlapping strips 14a, 14b, and 14c which comprise the border or web 14. In the next step, the sheet 46, as viewed in FIG. 5 is folded forward onto itself 180 degrees about the fold line C. The fabric is then refolded 180 degrees back onto itself such that the fold lines C and D now are coincident with each other, in the manner shown in FIG. 6, and the three strips 14a, 14b, and 14c, still enveloping the top part of the fabric 14d, are folded onto each other in overlapping relationship to form a three-ply thickness at the top of the bag.

With the top border of the bag now having been prepared, it is now desired to prepare the sheet so that the bottom of the bag may be constructed. Thus, as viewed in FIG. 4, the bottom of the sheet along the line A is taken up and folded 180 degrees along the line B. Line A is then folded back onto itself such that selvage A and fold line B are now coincident with each other and stitched together. When this fold is opened, the selvage 40 becomes hidden from view. The bottom A is now secured to the sheet 46 as by stitching at 50 as may be seen in FIG. 6.

The formation of the top of the bag represented by the border or web 14 and the bottom of the bag represented by the base 16 is illustrated still further in FIG. 7 where it can be seen that the border or web 14 is now assembled after the manner shown in FIG. 4 to be of triple ply construction and the base 16, as represented by the overlapping parts 16a and 16b, is of two-ply construction.

At this stage, grasping the material at the inner corner creases 28 in order to fold the material back upon itself a fraction of an inch, the vertical reinforcement provided to the bag is produced by placing the seam 29 on each of the inner corner creases 26 completely between the fold lines C-D and B-A as shown in FIG. 6. It is important in the method of constructing the preferred embodiment, that the stitching of the inner corner crease does not descend below the fold line B-A. With this operation completed, the sheet 46 may be turned over to expose the other side. An identical operation is then performed on each of the outer corner creases 26 so that a seam 29 extends along each of the creases 26 between the fold lines C-D and B-A. Likewise, the seam at the bottom of each of the corner creases 26 must terminate without extending below the fold line B-A.

At this point of the construction, the preparation of the sheet 46 for the formation of the border or web 14, the base 16, the front and rear panels 18 and 20, and the pleated side pieces 22, is now complete.

Figure 8:
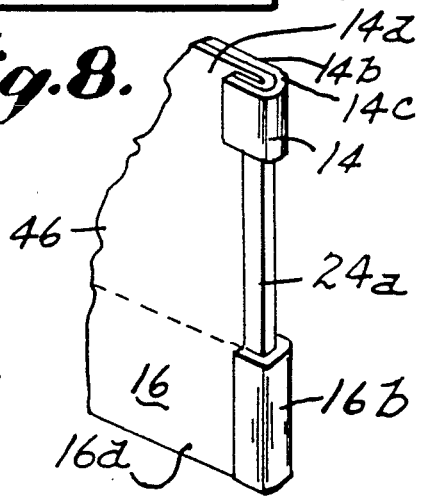
FIG. 8 is a fragmentary perspective view corresponding to FIG. 7 and showing the fabric after the ends of the fabric have been folded over upon themselves prior to connecting the ends to each other.

Since it is desired to have a bag which is reinforced at every conceivable point at which weakness might appear, reference is made to FIG. 8 which shows the formation of the side folds at the ends of the sheet as they appear in FIG. 7. The 180 degrees reverse bend shown in FIG. 8 illustrates the side fold at one end of the sheet prior to being attached to the other side fold by a flat-fell seam. The side folds, as illustrated in FIG. 8, are represented by the folded-over portions of the strips 14*a*, 14*b*, and 14*c* at the top of the bag and the strips 16*a* and 16*b* at the base 16 at the bottom of the bag.

Figure 9:
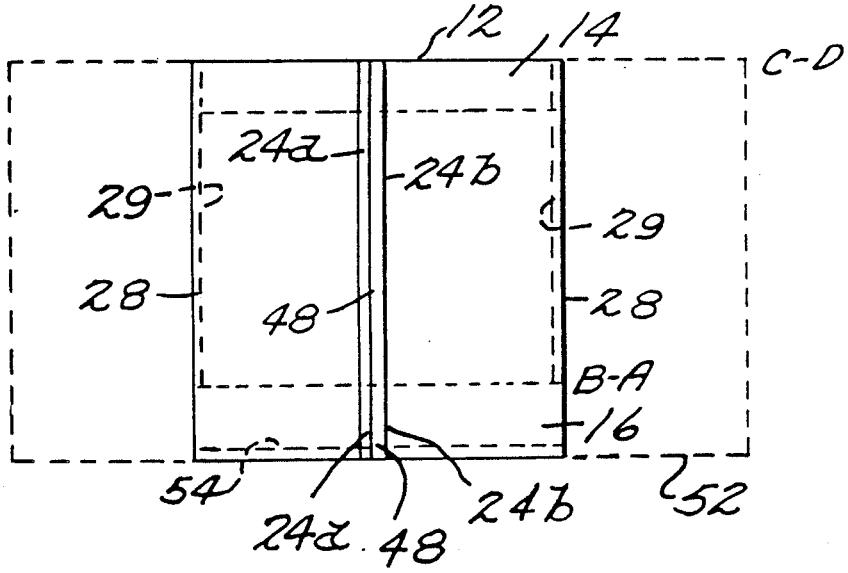
FIG. 9 illustrates the fabric corresponding to FIG. 6 showing the appearance of the partially formed bag after each half of the fabric has been folded over the inner crease fold such as to bring together the side folds for sewing into the back seam.

In order to form the back seam 24, it is necessary to prepare the material as shown in the layout in FIG. 9. The previous outline of the sheet illustrated in FIG. 6 is shown in phantom by the numeral 52. The fabric has now been turned over so that the interior surface of the bag is visible. The sheet 46 is now folded about the inner corner creases 28 and the ends thereof brought to the center line 48 in abutment with each other. After raising them from the paper as seen in FIG. 9, a flat-fell seam 24 is applied essentially at ⅝ inch from the ends of the fabric which is the normal seam allowance, from the top to the bottom of the bag such that the sheet 46 now assumes a tubular shape.

In the next stage, which is the formation of the bottom seam, with the sheet in the position as shown in FIG. 9, the back seam 24 and the center line 48 are now substantially aligned with each other. In this position, the bottom of the bag is closed by a flat-fell seam at 54, as may be seen in FIG. 9, from left to right of the sheet 46 completely between the corner creases 28. If desired, the stitching may be supplemented by additional stitching for extra strength At this stage of the production, the bag is closed along its vertical dimension by virtue of the back seam 24 and sealed at the base by the stitching 54 completely across the bottom of the bag. The bottom closure of the bag is preferably effected by a seam which extends approximately ½ inch from the bottom of the bag.

After the stitching 54 has been applied to the base such as shown in FIG. 9, the bag is inverted so as to have its exterior surface once again exposed. In other words, the bag is turned inside out so that the interior surface of the bag and the exterior surface of the bag appear such as is necessary to provide a commercial product. At this point the base material is tucked in to form the gussets 38 as shown in phantom in FIG. 3. The corner creases 26 of the bag are adjusted so that the bottom, in one exemplary construction, has a measurement of approximately 7¼ inches times 12¾ inches. In order to expose as much of the selvage as possible, a panel of the bottom surface is rolled back sufficiently to cause the appearance of the selvage 40 along both the short and long edges of the base 16. With the bag now turned right side out, the edge stitch 39 is applied to the base of the bag completely around its perimeter in order to connect the bottoms of the side pieces 22 to the base panels 32, 34 and 35. If desired, the gussets likewise may be secured to the bottom of the bag by appropriate machine procedures to stitch them into place.

The bag shown in FIG. 10 represents a completed article up to and including the installation of the handles 31. The base 16 of the bag is seen folded flat so that the three panels 32, 34, and 35 of the base are exposed to view. The seam line 29 represents the stitching applied to each of the outer corner creases 26. As discussed hereinabove, the seam which stitches the base 16 throughout its perimeter to the front and rear panels and to the two pleated side pieces is shown at 39. At this point, the selvage 40 preserved within the fabric from the outset of construction extends completely about the perimeter of the base 16 but is visible only along the outer edges of the base as shown by the stippled area in FIG. 10. It will be understood, of course, that other continuous lengths of the selvage extend along the short edges of the base but are hidden from view in FIG. 3 because of the integral connection made between the short edges of the base and the bottoms of the side pieces 22. Consequently, the base 16 of the bag now comprises two plies of the fabric and the thick web of the selvage is exposed to the environment in a position to resist any abrasive forces applied to the bottom of the bag. The overlapping folds of the gussets 38 as may be secured to the base folds provide additional strengthening of the bottom by virtue of their overlapping relationship with the multiple ply assembly of the base.

Figure 11:
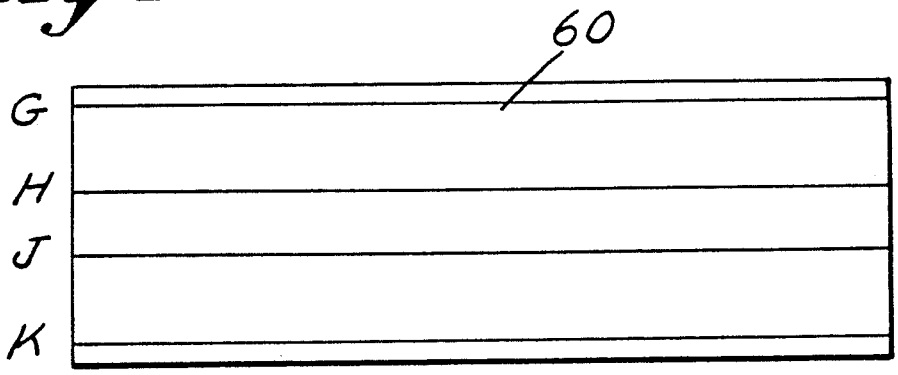
FIG. 11 illustrates a flat strip of fabric for use in making the handle shown attached to the bag in FIG. 10.
Figure 12A:
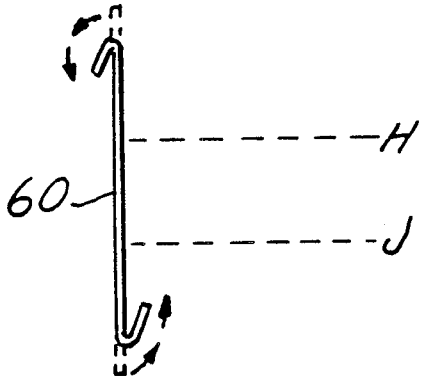
FIG. 12*a* and 12*b* illustrate, respectively, the strip of FIG. 11 partially and completely folded in the construction of the handle prior to attachment to the bag.
Figure 12B:
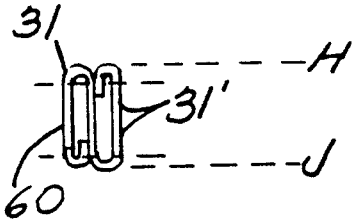

Since it is desired to assemble a handle with the bag 10, a suitable handle member is provided such as that illustrated in FIGS. 11 and 12*a*, 12*b* of the drawings. As stated earlier, a portion of the sheet from which construction of the bag was made was prepared and set aside for the construction of the handle. As such a strip 60 is shown in FIG. 11, and, for the sake of illustration, parallel fold lines G, H, J, and K, extending horizontally across the strip are shown to represent the fold lines in the making of the handle. The strip 60 first is folded down about the lines G and K and, with the two minor folds in place, the folding continues in the same direction of rotation to produce the multiple ply fold shown in FIG. 12*b*. Suitable stitching 31, is provided as is necessary to secure the multiple folds of the handle rigidly together one against the other. Preferably, parallel stitching applied a distance inward from the top and bottom of the handle shown in FIG. 12*b* would be appropriate.

In the next step of the assembly, as best represented in FIG. 10, the handle material 60 is bent into transverse portions to define the U-shaped article 31. Placed above the top of the bag in position for insertion and attachment, the handle 31 is assembled into the border or web 14 after the ends thereof are positioned on the front and rear panels 18 and 20 centrally thereto. Thus, at an appropriate distance inwardly of the outer corner creases 26, a slight separation is made between the strips 14*a*, *b*, and *c* to prepare an opening which extends downwardly into the border or web 14. The opening should be just wide enough and deep enough in order to accommodate the insertion of the handle 39 downwardly to a point extending into and slightly above the base of the border or web 14. Suitable stitching 62 applied appropriately between each anchor point of the handle and the border or web 14 secures the handle to the bag firmly with a minimum of disturbance to the upper end of the bag.

It will readily be appreciated that in the form of the handle described in conjunction with supporting the bag 10 embodying the invention, the handle is stitched completely along its entire length to provide maximum protection against any unraveling of the rough edge remaining from the removal of the strip of fabric which was applied to the construction of the handle. In addition, it will be apparent from FIG. 7 that the border or web 14 has three plies of construction between which the inserted end of the handle is contained. The placement of the multiple ply handle within the receiving multiple ply upper portion of the bag ensures a form of attachment which will not only readily support the contents of the bag but resist any twisting or turning or sudden motion of the handle relative to the top of the bag of the kind that might result in a separation. Also, the freedom of construction from any adhesive or bonding material between the elements of the handle remove the unappealing and often distasteful sensation associated with certain of the bags currently in use when the adhesive or bonding begins to dissolve or deteriorate under the pressure and warmth of the moistness of the palm. Furthermore, not only has the invention provided a handle with superior supporting characteristics, the harmony between the bag and the same material used to form the handle allow the handles to be essentially upright or totally vertical when the bag is opened and available for the reception of contents. Consequently, the handles are free from posing any obstruction to the operation of placing contents into the bag while it is being filled.

It will be obvious from the foregoing that the present invention of a shopping bag for general purpose use results in a structure which takes advantage of construction techniques not readily appreciated by prior manufacturers of articles of this kind. The selvage on the base of the fabric is extremely resistant to wear because of the heavier weave relative to the remainder of the fabric used in the manufacture of the bag. The pleated construction of the side panels not only allows the bag to fold compactly when not in use but the reinforcement seam provided at the corner creases of the side panels is such that the mouth of the bag is held essentially rectangular in shape for the reception of articles when the bag is placed in use. Also, not only is the base of the bag reinforced in its construction by having a plurality of plies of the fabric, the handle as well used to support the bag in the carrying of contents likewise is of multiple ply construction and, when attached to the border at the upper end of the bag, ensures a firm attachment which is strongly likely to resist any forces tending to detach the handle from the bag.

Accordingly, the above identified features of the present invention are illustrative only of the preferred embodiment of the present invention, and it is obvious that a variety of modifications and changes may be made without departing from the intended scope of the invention.

I claim:

1. A bag structure comprising parallel front and rear panels which face each other, said panels having longitudinal edges and upper portions, rectangular side pieces of pleated construction integrally connected to the corresponding longitudinal edges of said front and rear panels and extending transversely between said front and rear panels when the bag is open for reception of articles; a plurality of top strips at the upper portions of said front and rear panels and said side pieces, whereby a multiple ply border or web extends around the top of said bag; a base portion integrally connected to said side pieces and said front and rear panels to seal the bottom of said bag; said base portion having a selvage continuous around the perimeter of said base portion and having portions of said selvage exposed to the exterior of said bag; multiple bottom folds in said base portion in overlapping relationship with each other, whereby said base is of reinforced planar construction; means for reinforcing the corners of said side pieces extending from the top of said border or web to said base portion; and handle means attached to said border to web in a load-supporting relationship.

2. A bag structure in accordance with claim 1 wherein said top strips are of triple thickness and are infolded relative to each other at the border of said bag to conceal any cut edges by which raveling may occur.

3. A bag structure in accordance with claim 2 wherein said top strips are separated from each other at anchor points for said handle means.

4. A bag structure in accordance with claim 1 wherein said reinforcing means comprises folds gathered and stitched to define the corners of said bag.

5. A bag structure in accordance with claim 3 wherein said handle means is a U-shaped strip including a bight of which comprises multiple plies, said bight including ends of which extend into the separations in said top strips and are integrally connected to said border or web.

6. A bag structure in accordance with claim 1 further including a pair of gussets defined by base edges integrally connected to corresponding bottom edges of said side pieces and oppositely extending triangular bodies disposed within the interior of said bag in overlapping relationship with said bottom folds.

7. A bag structure in accordance with claim 1 wherein said panels, said side pieces, and said base portion are made of fabric.

8. A bag structure in accordance with claim 7 wherein said fabric is duck cloth.

9. A bag structure in accordance with claim 8 wherein said duck cloth is prewashed.

10. A bag structure in accordance with claim 8 in which said duck cloth is durable and rigid enough to allow said bag to stand upright when open for the insertion of goods.

* * * * *